US006203384B1

(12) United States Patent
DeFrance

(10) Patent No.: US 6,203,384 B1
(45) Date of Patent: Mar. 20, 2001

(54) MULTI-TAP PAD MOUNT CONNECTOR

(75) Inventor: Robert DeFrance, Poughkeepsie, NY (US)

(73) Assignee: Maclean Power Systems, Franklin Park, IL (US)

( * ) Notice: Subject to any disclaimer, the term of this patent is extended or adjusted under 35 U.S.C. 154(b) by 0 days.

(21) Appl. No.: 09/274,121

(22) Filed: Mar. 23, 1999

(51) Int. Cl.[7] ..... H01R 11/09
(52) U.S. Cl. ..... 439/798; 439/797
(58) Field of Search ..... 439/798, 796, 439/797, 807, 814

(56) References Cited

U.S. PATENT DOCUMENTS

| | | | | |
|---|---|---|---|---|
| 2,943,294 | | 6/1960 | Norden . | |
| 2,976,514 | | 3/1961 | Stanback et al. . | |
| 3,001,172 | | 9/1961 | Cornell, Jr. . | |
| 3,133,779 | | 5/1964 | Stanback . | |
| 3,516,049 | | 6/1970 | Goodridge . | |
| 3,546,364 | | 12/1970 | O'Neel . | |
| 3,725,851 | | 4/1973 | Linn . | |
| 3,736,550 | | 5/1973 | Wallace et al. . | |
| 3,794,963 | * | 2/1974 | Cooper, Jr. | 339/242 |
| 4,214,806 | * | 7/1980 | Kraft | 339/242 |
| 4,382,651 | * | 5/1983 | Klosin et al. | 339/92 R |
| 4,456,326 | | 6/1984 | Sauber . | |
| 5,189,596 | | 2/1993 | Runge . | |
| 5,199,905 | * | 4/1993 | Fillinger | 439/723 |
| 5,690,516 | | 11/1997 | Fillinger . | |
| 5,931,708 | * | 8/1999 | Annas et al. | 439/798 |

* cited by examiner

*Primary Examiner*—Steven L. Stephan
*Assistant Examiner*—Phuong KT Dinh
(74) *Attorney, Agent, or Firm*—Pitney, Hardin, Kipp & Szuch, LLP

(57) ABSTRACT

The multi-tap pad connector includes an integral conductive body with a longitudinal axis. A threaded female blind aperture is formed about a portion of the longitudinal axis for receiving the output from a secondary side of a transformer or similar electrical source. The body further includes a plurality of secondary electrical connection channels which are oriented perpendicularly with respect to the longitudinal axis. Oblique flanges are formed over the secondary electrical connection channels and include threaded apertures therethrough. The threaded apertures are directed to the secondary electrical connection channels. Allen set screws pass through the threaded apertures and into the secondary electrical connections channels to secure the secondary connectors both electrically and mechanically to the multi-tap pad connector.

14 Claims, 3 Drawing Sheets

MULTI-TAP PAD MOUNT CONNECTOR

BACKGROUND OF THE INVENTION

1. Field of the Invention

This invention pertains to a multi-tap pad mount connector wherein the secondary conductor ports are formed as channels perpendicular to the primary bush stud connection. Additionally, the channel include allen set screws which are perpendicular to the secondary conductor ports but at an oblique angle with respect to the longitudinal axis about which the primary bush stud connection is formed.

2. Description of the Prior Art

In the prior art, it is known to provide a pad mount for such purposes as feeding the electrical output of the secondary side of a transformer to a plurality of secondary lines. Many of these pad mounts, however, arrange the secondary lines at different angles, have connectors for the secondary lines which interfere or obstruct each other so that at least some of the connectors are inaccessible, and/or require the ends of the secondary lines to be pushed longitudinally through openings or wrapped around screws or similar posts, which can be difficult if the secondary lines are frayed or if the connectors are inaccessible. Similarly, the prior art frequently requires that the ends of the conductor of the secondary lines are free of burrs.

Recent examples of prior art in this field in U.S. Pat. No. 5,690,516 entitled "Transformer Stud Electrical Connector", issued on Nov. 25, 1997 to Fillinger; U.S. Pat. No. 5,199,905 entitled "Lay-In Pedestal Connector Bar and Method", issued on Apr. 6, 1993 to Fillinger; and U.S. Pat. No. 5,189,596 entitled "Transition for Electrical Apparatus", issued on Feb. 23, 1993 to Runge.

OBJECTS AND SUMMARY OF THE INVENTION

It is therefore an object of this invention to provide a multi-tap pad connector which aligns the secondary connectors to be parallel with each other.

It is therefore a further object of this invention to provide a multi-tap pad connector in which the connectors are all substantially accessible and free from interference from one another.

It is therefore a still further object of this invention to provide a multi-tap pad connector in which the ends of the wires of the secondary connectors are not required to be pushed longitudinally through an aperture.

It is therefore a still further object of this invention to provide a multi-tap pad connector in which the ends of wires of the secondary connectors are not required to be wrapped around a screw or similar post.

It is therefore a still further object of this invention to provide a multi-tap connector which can accommodate burrs on the ends of the conductors of the secondary lines.

These and other objects are attained by providing a multi-tap pad connector in which a female threaded element is formed along the longitudinal axis for receiving the bushing stud from the secondary side of a transformer. Open channels are formed along the body of the multi-tap pad connector which intersect the longitudinal axis, but are perpendicular thereto, thereby positioning the secondary connectors parallel to each other and perpendicular to the bushing stud from the secondary side of the transformer. The open channels allow the secondary conductors to be laid laterally into the open channels, rather than axially inserted through an aperture. A wall of the channel is formed obliquely to the longitudinal axis and threaded set screw apertures are formed therein so that the set screws which effectively close the channel and engage the secondary connectors therein are perpendicular to the open channels but oblique to the longitudinal axis of the pad connector. This arrangement of the set screws provides for high accessibility of the set screws and minimal or no interference therebetween.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
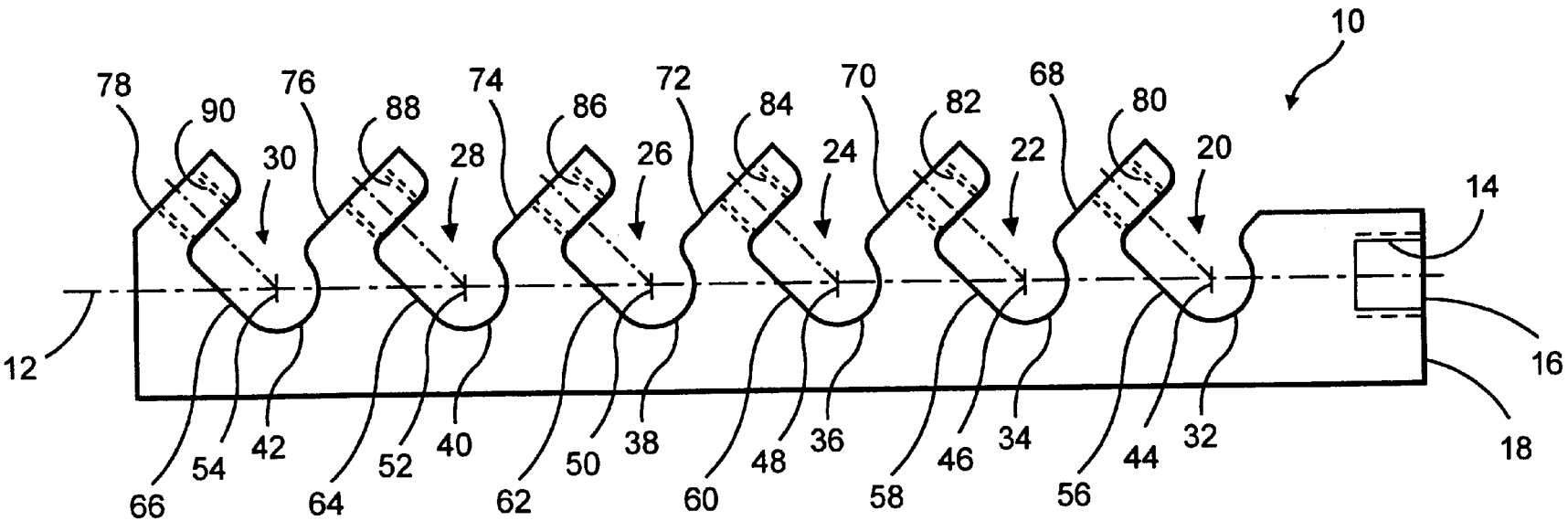
FIG. 1 is a side plan view, partially in phantom, of the multi-tap pad connector of the present invention.

Referring now to the drawings in detail wherein like numerals refer to like elements throughout the several views, one sees that FIG. 1 is a side plan view, partially in phantom, of multi-tap pad connector 10. Multi-tap pad connector 10 is formed of a unitary piece of conductive material, such as aluminum. Longitudinal axis 12 is directed through the middle of multi-tap pad connector 10. The centerline of female threaded blind aperture 14 is formed along a portion of longitudinal axis 12. Mouth 16 of female threaded blind aperture 14 is formed on end 18 of multi-tap pad connector 10. Female threaded blind aperture 14 receives the threaded stud of a bushing of the secondary side of a transformer (not shown). This secondary side of the transformer provides the primary or feeder line for multi-tap pad connector 10 via female threaded blind aperture 14.

Figure 2:
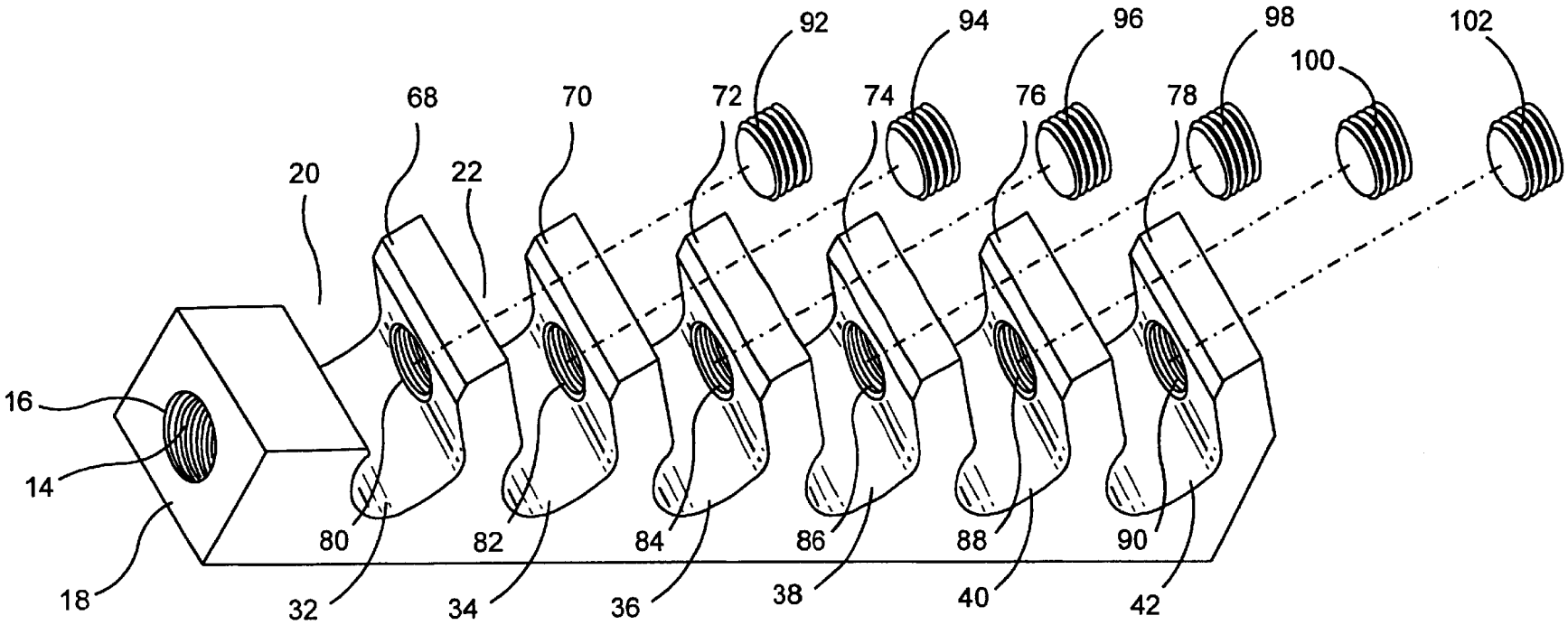
FIG. 2 is a perspective view of the multi-tap pad connector of the present invention with the set screws illustrated in an exploded position.

As shown on FIG. 2, secondary line tap connector channels 20, 22, 24, 26, 28, 30 are formed perpendicularly to longitudinal axis 12 and include lower partially circular nesting portions 32, 34, 36, 38, 40, 42 with respective centers of curvature 44, 46, 48, 50, 52, 54 through which longitudinal axis 12 passes.

Secondary line tap connector channels 20, 22, 24, 26, 28, 30 further include oblique planar portions 56, 58, 60, 62, 64, 66 rising from respective lower partially circular nesting portions 32, 34, 36, 38, 40, 42. Oblique flanges 68, 70, 72, 74, 76, 78 are substantially perpendicular to oblique planar portions 56, 58, 60, 62, 64, 66 and likewise at an oblique angle of 45° to longitudinal axis 12. Oblique flanges 68, 70, 72, 74, 76, 78 include respective threaded apertures 80, 82, 84, 86, 88, 90 which threadably engage respective alien set screws 92, 94, 96, 98, 100, 102 (see FIG. 2). Threaded apertures 80, 82, 84, 86, 88, 90 and respective allen set screws 92, 94, 96, 98, 100, 102 are oriented obliquely at a 45° angle with respect to longitudinal axis 12, but perpendicularly with respect to secondary line tap connector channels 20, 22, 24, 26, 28, 30. Threaded apertures 80, 82, 84, 86, 88, 90 are oriented toward respective centers of curvature 44, 46, 48, 50, 52, 54 so that respective allen set screws 92, 94, 96, 98, 100, 102 pass through respective centers of curvature 44, 46, 48, 50, 52, 54 so as to engage secondary electrical connectors (not shown) securely, both electrically and mechanically, within respective lower partially circular nesting portions 32, 34, 36, 38, 40, 42. The arrangement and orientation of oblique flanges 68, 70, 72, 74, 76, 78 allows simple access to respective allen set screws 92, 94, 96, 98, 100, 102 and to respective secondary line tap connector channels 20, 22, 24, 26, 28, 30.

Figure 3:
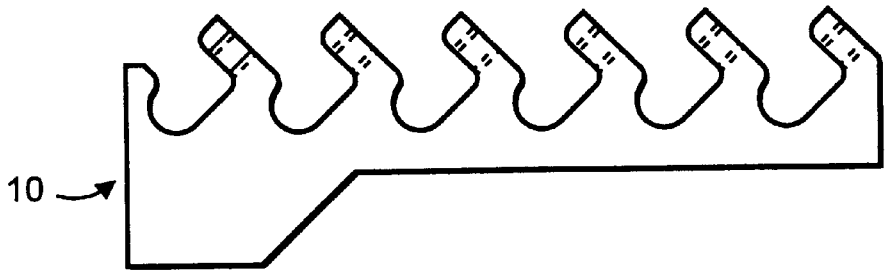
FIG. 3 is a side perspective view of a first alternative embodiment of the multi-tap pad connector of the present invention.
Figure 4:
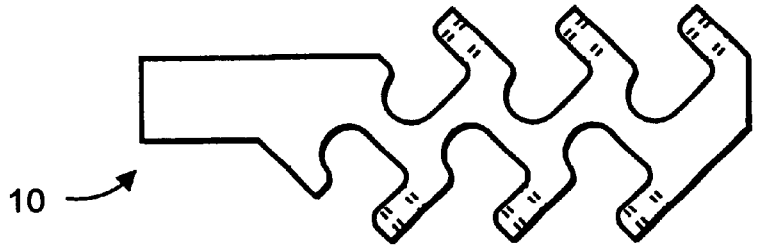
FIG. 4 is a side perspective view of a second alternative embodiment of the multi-tap pad connector of the present invention.
Figure 5:
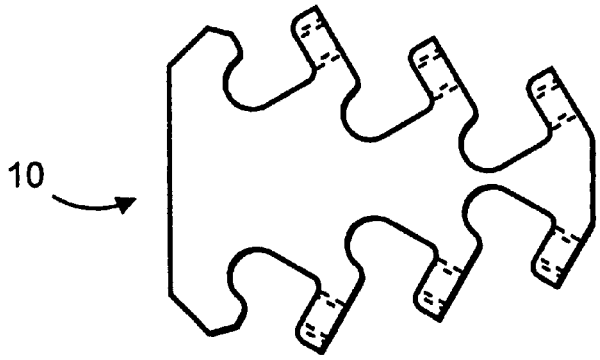
FIG. 5 is a side perspective view of a third alternative embodiment of the multi-tap pad connector of the present invention.

Alternative embodiments are disclosed in FIGS. 3–5.

To install multi-tap pad connector 10, the installer typically threads the threaded stud of a bushing of the secondary side of a transformer (not shown) into female blind threaded aperture 14 thereby providing the feeder or primary line to multi-tap pad connector 10. The installer then strips the insulation from the secondary connector wires (not shown) and places the exposed conductors laterally into secondary line tap connector channels 20, 22, 24, 26, 28, 30 and then tightens alien set screws 92, 94, 96, 98, 100, 102 to tightly engage the conductors of the secondary connector wires, both mechanically and electrically. This lateral placement of the secondary conductor wires into secondary line tap connector channels 20, 22, 24, 26, 28, 30 allows multi-tap pad connector 10 to accommodate frayed or burred secondary conductor wires.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. An electrical connector including:

an integral conductive body member with a longitudinal axis;

means in said body member for receiving a primary electrical connection said means for receiving said primary electrical connection is along or substantially parallel to said longitudinally axis;

a plurality of secondary electrical connection channels in said body member perpendicular to said longitudinal axis;

a plurality of flanges, each of said flanges of said plurality of flanges being oriented over a respective secondary electrical connection channel at an oblique angle to the longitudinal axis, each of said flanges of said plurality of flanges including means for electrically and mechanically securing a secondary electric connector in a respective secondary electrical connection channel; and said means for securing a secondary electrical connector includes a threaded aperture passing through said flanges and a threaded male member passing through said threaded aperture and extending into respective secondary electrical connection channels at an oblique angle to that of the longitudinal axis.

2. The electrical connector of claim 1 wherein each of said secondary electrical connection channels of said plurality of secondary electrical connection channels includes a curved portion with a center of curvature, wherein said centers of curvature lie in a common plane.

3. The electrical connector of claim 2 wherein said longitudinal axis passes through each of said centers of curvature.

4. The electrical connector of claim 1 wherein said means for receiving a primary electrical connection comprises a threaded blind aperture in said body member.

5. The electrical connector of claim 1 wherein said means for securing a secondary electrical connector includes a threaded aperture passing through said flanges and a threaded male member passing through said threaded aperture and extending into said secondary electrical connection channel.

6. The electrical connector of claim 1 wherein a centerline of said threaded aperture passes through said center of curvature of said respective secondary electrical connection channel.

7. The electrical connector of claim 6 wherein said centerline of said threaded aperture is oblique with respect to said longitudinal axis.

8. An electrical connector including:

an integral conductive body member with a longitudinal axis;

means in said body member for receiving a primary electrical connection said means for receiving said primary electrical connection is along or substantially parallel to said longitudinally axis;

a plurality of secondary electrical connection channels in said body member perpendicular to said longitudinal axis;

a plurality of flanges, each of said flanges of said plurality of flanges being oriented over a respective secondary electrical connection channel at an oblique angle to the longitudinal axis;

means for electrically and mechanically securing a secondary electric connector in a respective secondary electrical connection channel;

said plurality of secondary electrical connection channels having respective openings adjacent respective flanges for receiving secondary electrical connector in a laid in manner; and said secondary electrical connection channels of said plurality of secondary electrical connection channels are positioned in a row one adjacent to the next, each having a curved portion with a center of curvature, wherein said centers of curvature lie in a common plane.

9. The electrical connector of claim 8 wherein said longitudinal axis passes through each of said centers of curvature.

10. The electrical connector of claim 8 wherein said means for securing a secondary electrical connector includes a threaded aperture and a threaded male member passing through said threaded aperture and extending into respective secondary electrical connection channels at an oblique angle to that of the longitudinal axis.

11. The electrical connector of claim 10 wherein a centerline of each of said threaded aperture passes through said center of curvature of said respective secondary electrical connection channel.

12. The electrical connector of claim 11 wherein said centerline of said threaded aperture is oblique with respect to said longitudinal axis.

13. The electrical connector of claim 8 wherein said means for receiving a primary electrical connection comprises a threaded blind aperture in said body member.

14. An electrical connector including:

an integral conductive body member with a longitudinal axis;

means in said body member for receiving a primary electrical connection said means for receiving said primary electrical connection is along or substantially parallel to said longitudinally axis;

a plurality of secondary electrical connection channels in said body member positioned in a row one adjacent to the next each of which includes a curved portion with a center of curvature, wherein said centers of curvature lie in a common plane;

a plurality of flanges, each of said flanges of said plurality of flanges being oriented over a respective secondary electrical connection channel at an oblique angle to the common plane;

means for electrically and mechanically securing a secondary electric connector in a respective secondary electrical connection channel which includes a threaded aperture and threaded male member passing through said threaded aperture and extending into respective secondary electrical connection channel at an oblique angle to that of the common plane.

* * * * *